US005715869A

United States Patent [19]

Patterson

[11] Patent Number: 5,715,869

[45] Date of Patent: Feb. 10, 1998

[54] APPARATUS PRIMARILY FOR THAWING FROZEN PIPES

[76] Inventor: Kelly J. Patterson, 67, Honey's Beach Road, RR#1, Port Perry, Ontario, Canada, L9L 1B2

[21] Appl. No.: 628,131

[22] Filed: Apr. 4, 1996

[30] Foreign Application Priority Data

Apr. 11, 1995 [CA] Canada ..... 2146830

[51] Int. Cl.[6] ..... E03B 7/14

[52] U.S. Cl. ..... 138/35; 138/32; 15/104.61; 134/168 C; 134/167 C; 134/168 R

[58] Field of Search ..... 138/32, 35; 15/104.061; 134/168 C, 168 R, 167 R

[56] References Cited

U.S. PATENT DOCUMENTS

| | | | |
|---|---|---|---|
| 4,124,039 | 11/1978 | St. Laurent | 138/35 |
| 4,250,925 | 2/1981 | Mast | 138/35 |
| 4,449,553 | 5/1984 | Sullivan et al. | 138/35 |
| 4,773,113 | 9/1988 | Russell | 134/168 C |
| 4,838,768 | 6/1989 | Flaherty | 15/104.061 |
| 4,905,900 | 3/1990 | Scharton et al. | 15/316.1 |
| 4,986,311 | 1/1991 | Mikkelson | 138/35 |
| 5,178,684 | 1/1993 | Hutchins, Sr. | 134/22.11 |
| 5,193,587 | 3/1993 | Miller, Jr. | 138/35 |

*Primary Examiner*—David Scherbel
*Assistant Examiner*—James F. Hook
*Attorney, Agent, or Firm*—Jones, Tullar & Cooper, P.C.

[57] ABSTRACT

Apparatus is provided for thawing frozen pipes or for cleaning pipes, for use with a source of warm thawing water or cleaning water, a source of compressed air, and a flexible tube suitable for being inserted into the end of a pipe through guide means to feed the water into the pipe while the tube is being advanced into the pipe. The apparatus comprises a valved water conduit having an inlet for connection to the source of water and an outlet for connection to the flexible tube, this conduit having a movable valve. A compressed air powered drive, usually a rotator, connectable to said source of compressed air, is arranged to move the valve in such manner as to continually interrupt the flow of water in the conduit and so to produce a pulsating flow of water in the tube for thawing ice in the frozen pipe or cleaning the pipe. The rotator for the valve may be a compressed air driven ratchet drive. A valve may also be provided for injecting air into the pipe to clear out ice or dirt.

19 Claims, 3 Drawing Sheets

APPARATUS PRIMARILY FOR THAWING FROZEN PIPES

BACKGROUND OF THE INVENTION

1. Field of the Invention

The present invention relates to thawing of frozen pipes, generally pipes providing a domestic water supply. While the invention provides apparatus primarily for the thawing of pipes, the apparatus may also be used for cleaning out such pipes.

2. Prior Art

In conditions of extreme cold, water pipes supplying domestic water sometimes freeze. In former times these pipes were usually of metal, and could be thawed using electrical resistance heating or external heating. Nowadays, however, many pipes are made of plastic and cannot be thawed by these methods. Apart from this, use of electricity has its dangers. Accordingly, the more modern way to thaw pipes is to cut open the incoming pipe, most usually where it enters a basement, and to introduce into the pipe end a flexible tube carrying a warm, thawing water. As the water thaws the ice, the tube is fed along the pipe so that its outlet end is always close to the ice being melted. The tube is usually fed through a guide inserted into the end of the pipe, this guide fitting around the tube in a substantially leakproof manner and having a side outlet for cold water returning from the pipe, which can be fed back to a reservoir or a drain. Examples of prior patents showing such systems are as follows:

U.S. Pat. No. 4,124,039, issued Nov. 7, 1978 to St. Laurent;

U.S. Pat. No. 4,250,925, issued Feb. 17, 1981 to Mast;

U.S. Pat. No. 4,449,553, issued May 22, 1984 to Sullivan et al.;

U.S. Pat. No. 4,986,311, issued Jan. 22, 1991 to Mikkelson;

U.S. Pat. No. 5,193,587, issued Mar. 16, 1993 to Miller. Jr.

One drawback of the systems described in these patents, and of other systems of which I am aware, is that the apparatus is heavy and bulky, and relatively expensive, because it includes a tank or reservoir, with a heater, to provide a source of thawing water. Usually such apparatus needs to be carried on a cart, making it awkward to take down to a basement.

Also, all of the systems shown in the patents, and most of those known to me, use an electrically driven pump for delivering the thawing water. In many cases also, an electric heater is used to heat the thawing water. The use of electricity poses hazards in using such equipment due to the amount of water which is likely to be spilled into the basement during the thawing.

SUMMARY OF THE INVENTION

The present invention provides apparatus primarily for thawing frozen pipes in the domestic situation, which is easily portable; the main components can be carried in a box similar to a tool box, in one hand. Use of a reservoir is optional, depending on circumstances. Also, no electricity needs to be used. The apparatus may also be used for cleaning out pipes.

The use of a reservoir can usually be avoided by making use of the water system of the house affected by the frozen pipe. This is because it is usual, when water supply to a house is interrupted by a frozen pipe, for a temporary supply to be obtained from a neighbouring house. Commonly, a garden hose is used to connect hose outlets of the two houses; a constant steady flow being used to prevent freezing. The temporary supply of cold water into the system can also feed the hot water tank of the affected house, so that this house does have a supply of hot water, although at reduced pressure. This supply of hot water is usually sufficient for use in the thawing system of this invention.

The use of electricity in a basement is avoided by making use of compressed air as a source of power, using a compressor outside the house.

In accordance with the present invention, apparatus primarily for thawing frozen pipes, for use with a source of thawing or cleaning water, a source of compressed air, and a flexible tube suitable for being inserted into the end of a pipe through guide means to feed the water into the pipe while the tube is being advanced into the pipe, has a valved water conduit having an inlet for connection to the source of water and an outlet for connection to the flexible tube. Compressed air may be used with this basic conduit, in three ways.

Firstly, a valve may be provided in the water conduit, and this valve may be connected to a compressed air driven device connected to the source of compressed air and arranged to continually move the valve in such manner as to repeatedly interrupt the flow of water in the conduit and so to produce a pulsating flow of water in the tube for thawing ice in a frozen pipe, or for cleaning a pipe. Preferably, the valve is a rotary valve such as a ball valve, and this is continually rotated at a relatively low speed, for example less than 100 r.p.m. A suitable rotator for this purpose is a power wrench tool known as a "ratchet" or "ratchet drive", and which incorporates a ratchet mechanism. It is known that pulsations in the water pressure assist in feeding the tube into a frozen pipe; see, for example the patent to Miller, Jr., mentioned above.

Secondly, compressed air may be injected periodically into the pipe to assist in cleaning out ice, slush, or dirt. For this purpose, the invention further comprises a compressed air conduit having an inlet for connection to the source of compressed air, an outlet connected to the valved water conduit, and a valve which allows compressed air to be injected periodically into the water conduit.

Thirdly, where water pressure within the affected house is not sufficient for it to be used directly for injection into the frozen pipe, its pressure may be increased by:

a) providing a pump, driven by compressed air, which is conveniently a part of the portable apparatus of the invention; or b) providing a connection from the compressed air source into the domestic water system, to increase its pressure. For this purpose, an air line can be connected from the air compressor to a hot water faucet to increase the pressure in the house's hot water tank.

The compressed air driven pump may be a gear pump driven by a compressed air driven rotator such as a compressed air drill. Such a pump may be used along with a compressed air driven device, such as the rotating valve, to produce pulsating air pressure. Alternatively, a compressed air driven reciprocating pump may be used, since such a pump can produce both the necessary pressure, and suitable pulsations. A so-called "barrel" pump is a reciprocating pump which is suitable for this purpose. Such pumps are sold as "low pressure suction pumps" by Stewart-Warner Alemite & Instrument Corp. of Chicago, Ill., under Model Nos. 8569-4, 8569-A4, and 8569-B1. These can of course be used along with means for compressed air injection, as described.

The apparatus of the invention, and specifically the valved water conduit, the valve in the water conduit and its compressed air driven moving device, and the compressed air driven pump, may be carried in a box-like container having a carrying handle and suitable for being carried by one hand. The only heavy and bulky part of the apparatus is the compressor, which does not need to be taken down into a basement.

BRIEF DESCRIPTION OF THE DRAWINGS

Preferred arrangements in accordance with the invention will now be described, by way of example, with reference to the accompanying drawings, in which.

DETAILED DESCRIPTION

Figure 1:
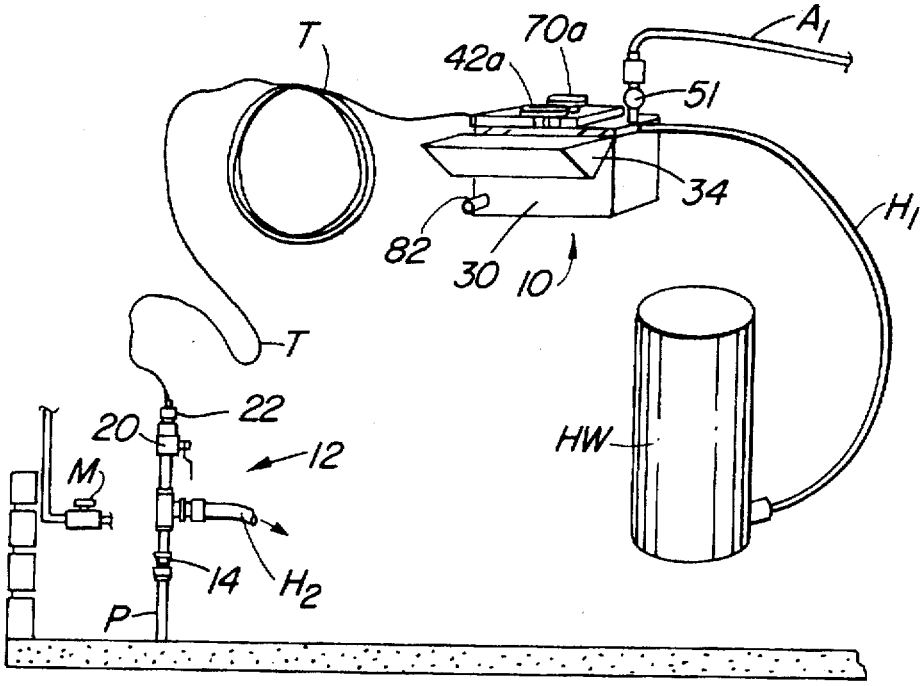
FIG. 1 is a diagrammatic view of apparatus of this invention being used in the basement of a house.
Figure 1A:
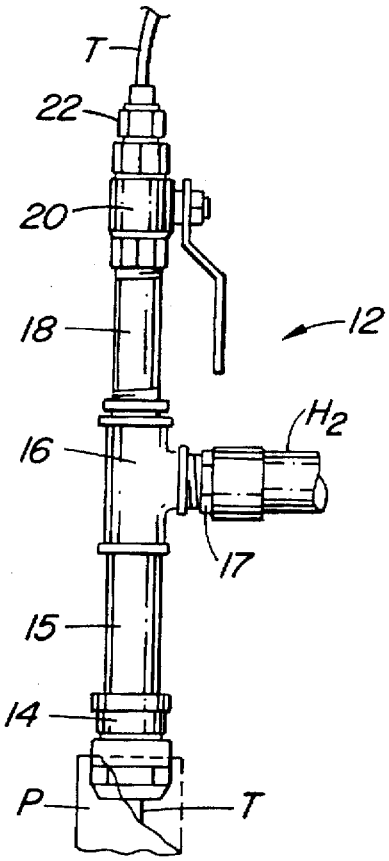
FIG. 1*a* shows an enlarged view of part of the apparatus of FIG. 1.

Referring to FIGS. 1 and 1*a*, the basic portable unit 10 of this invention is shown being used to thaw a frozen incoming water pipe P, close to the point of entry into a basement. The unit is shown being used with a hose $H_1$ connected to the hot water tank HW of the affected house and providing a supply of thawing water to unit 10; this water leaves the unit via a flexible tube T which is preferably ⅜ inch plastic air brake tubing. The length of tube T provided will usually be 125 ft., although longer lengths up to 200 ft. may be used. The unit is powered by air from a compressed air line $A_1$ connected to a compressor (not shown), which can remain outdoors. A gasoline or electric powered compressor may be used; this should be capable of providing about 10 cfm at 90 psi; however 5 cfm is sufficient if only one air line is used (see below). Alternatively, a truck having air brakes can be provided with an air outlet fitting to supply the compressed air.

To gain access to the end of pipe P, it is cut close to its connection to the water meter M, and the open end is connected to an assembly indicated generally at 12 in FIGS. 1 and 1*a*. This assembly includes firstly a copper compression coupling 14 suitable for fitting onto the open pipe end in a substantially leak proof manner; a Mueller (trademark) coupling is suitable; the size will vary but is usually ¾ inch.

A nipple 15 connects coupling 14 to a Tee junction 16, this having a side branch connected to an adaptor 17 for a hose $H_2$ which carries away cold water and melted ice. Another nipple 18 connects the junction 16 to a full port ball valve 20, in which is fitted a compression adapter coupling 22 which in turn receives the flexible tube T. This coupling is in the nature of a gland which allows the tube to slide into the end of the assembly 12, and thus into the pipe, in a largely leak-proof manner. The tube T is advanced so that its tip is always close to the ice in the pipe, and melted ice leaves the pipe through hose $H_2$. The tube T preferably has a tapered end to facilitate its feeding through the pipe; the tapered end may be bent inwardly to prevent it snagging on fittings or bends.

Figure 2A:
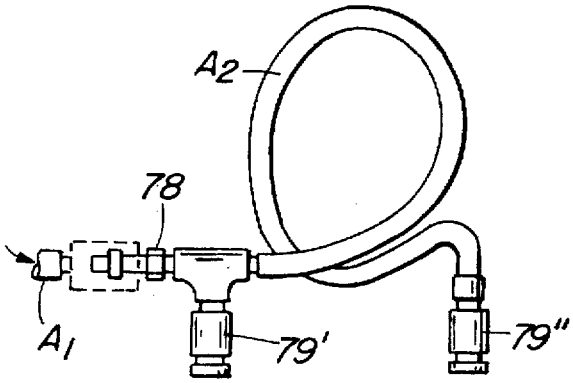
FIG. 2*a*, which appears on the same drawing sheet as FIG. 1, shows an accessory air line.
Figure 2:
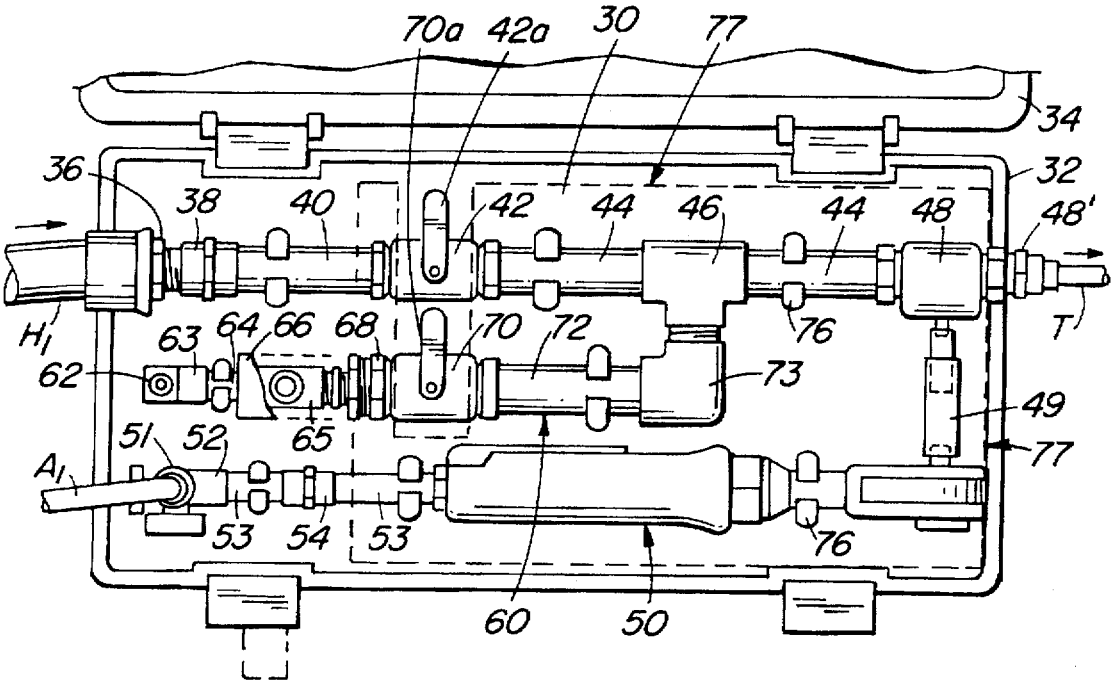
FIG. 2 is a top plan view of a box-like container carrying the main components of the invention.

FIG. 2 shows details of the essential parts of apparatus 10 as used in the arrangement of FIG. 1. These essential parts are contained on a removable tray 30 which rests in the upper part of a container 32 modelled on a standard tool box, and which has a hinged lid 34 with an integral carrying handle, this whole apparatus being easily carried by one hand.

The items carried by tray 30 include a first water conduit including an inlet end adaptor 36 which receives the inlet hose $H_1$, and this is connected by coupling 38 and nipple 40 to a full port ball valve 42 having handle 42*a*. This valve is connected by nipples 44 and Tee 46 to a another ball valve 48, the outlet end of which is provided with a compression adaptor coupling 50, in turn connected to the tube T. The ball valve 48 is preferably a "Series B-6400" standard port valve made by Watts Regulator Company, of Woodbridge, Ontario, Canada; this valve is preferred since it gives a quick closing action which is good for producing pressure pulses. The valve 42 may be a series FBV full port valve made by the same company.

The ball valve member of valve 48 is arranged to be rotated by a connecting nut and a ⅜ inch drive deep socket 49 rotatably driven by a compressed air driven rotator 50, specifically a ⅜ inch drive air powered ratchet tool such as the "professional ratchet" model PL 1501 sold by Campbell Hausfeld, of Harrison, Ohio, U.S.A. This is an air powered ratchet wrench normally used for removing and installing spark plugs and other engine parts, and having a rotary air driven motor driving a ratchet mechanism through an eccentric. It provides an output with an adjustable speed, with a maximum r.p.m. of 150, but which can be adjusted to speeds less than 100 r.p.m. The compressed air is supplied to this ratchet from airline $A_1$ having a (female) quick connect coupling which fits onto a (male) quick connector fitting in the top of a combined air regulating valve and pressure gauge 51, and by an elbow 52, and nipples 53 joined by coupling 54.

It will be evident that other kinds of ratchet drives may be used, for example those which use a reciprocating piston to drive the ratchet mechanism. Also, it may be possible to use a rotary air motor, suitably geared down, without a ratchet mechanism.

The tray 30 also carries a compressed air conduit 60 having, as its inlet, a snifter valve 62 mounted on an elbow 63, which is connected by nipple 64 to a Tee 65 carrying an air pressure gauge 66. The Tee 65 is connected by adapter bushing 68 to ball valve 70, which is similar to valve 42, and which has a manually operable handle 70*a*. The ball valve is connected by nipple 72 to elbow 73, in turn connected by a short nipple into Tee 46. This arrangement allows compressed air to be injected into the water conduit by opening the ball valve 70 and applying an air supply to the snifter valve 62.

The parts described above as carried by tray 30 are held onto the tray by clips 76. Most of the parts, i.e. those in the right hand two-thirds of tray 30, are covered by a panel 77, indicated in broken lines in FIG. 2, and which has depending flanges at its sides, and apertures allowing access to items such as valve handles 42*a* and 70*a*. This panel protects the operator from moving parts such as the ratchet drive, and is also used to carry operating instructions.

In operation, the pipe P is cut in the usual way, preferably after ensuring that the meter side is grounded by connecting this to the incoming water pipe with a booster cable, to prevent any electric shocks coming from a fault in the house's wiring. The assembly 12 is fitted to the pipe end, with the adapter coupling 14 providing a water-tight fit onto the pipe. Hose $H_2$ is connected to Tee 16, and leads to a suitable drain outlet. Tube T is connected between the inlet fitting 22 of assembly 12 and the outlet coupling 50 from the unit 10. A hose $H_1$ is connected between an available source of warm water, for example a hot water tank HW, and the inlet adaptor 36 of the water conduit of unit 10, with valve 42 closed. Air line $A_1$ is then connected to air regulating valve 51, and this valve is then adjusted to cause the ratchet tool 50 to rotate the valve 48 at a suitable rate, about 80 r.p.m. With supply of water into hose $H_1$ turned on, the valve 42 is opened to allow the warm water to flow into tube T and thence into pipe P, melting the ice therein. As the ice in the pipe melts, the tube T is manually advanced through coupling 22; the rotation of the valve 48 produces repetitious interruptions of the water supply giving pulsations of water pressure which assist in feeding of the tube against the pressure of water. The water produced from the melted ice leaves through hose $H_2$.

At intervals throughout the process air may be injected to help clear away slush, etc., in the pipe. For this purpose the valve 42 is closed and valve 70 is opened, the quick connect coupling on the end of air line $A_1$ is removed from the male quick connector on valve 51, a tire chuck inflating valve is applied to this coupling, and this inflating valve is then applied to the snifter valve 62 for a short time. This operation injects compressed air through conduit 60 into the water conduit and clears the frozen pipe of slush and cold water, speeding up the thawing operation, and maintaining progress if the thawing operation is interrupted. When air is noticed escaping from the drain hose $H_2$, the air hose is released from the snifter valve, the chuck is removed from the air line, and the air line coupling is re-attached to valve 51. The thawing operation continues.

When the pipe has been successfully thawed, water will rush out of hose $H_2$; it is desirable to let this water flow for several minutes to clear slush and dirt which has accumulated. During this time, tube T is withdrawn through the coupler 22, after which valve 20 is closed. The water is then turned off at the source or at the curb stop, and the pipe is then reconnected to the meter by a copper to copper compassion coupling; a Ford (trademark) coupling is preferred for this purpose.

Operation in the manner described, using a single air line, requires the smallest compressor capacity; about 5 cfm being sufficient.

FIG. 2*a* shows an accessory air line $A_2$ which may be used to make operation more convenient, although this requires some additional compressor capacity. This accessory air line has an inlet end male quick connector 78 for receiving the coupling of the air line $A_1$. This connector is received by a Tee, having a quick coupling (female) 79' on one branch, and with its other branch connected to a coiled length of air line $A_2$. This in turn leads to another female quick coupling 79". This accessory can be used with the apparatus of FIG. 2, by removing the snifter valve 62 from the air conduit and replacing this with a male quick connector inserted into elbow 63, and then attaching the respective couplings 79' and 79" to the male quick connectors at valve 51 and elbow 63. With this arrangement, air can be injected simply by opening the valve 70.

Figure 3:
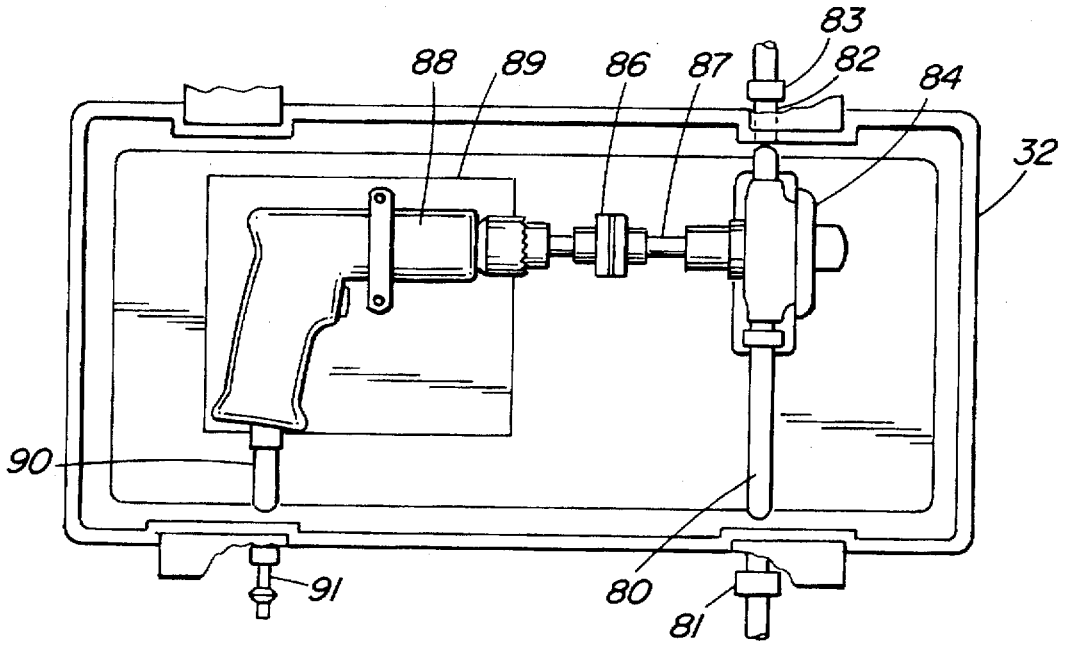
FIG. 3 is a view similar to that of FIG. 2, but with an upper part of the container removed to show other components in a lower portion of the container.
Figure 4:
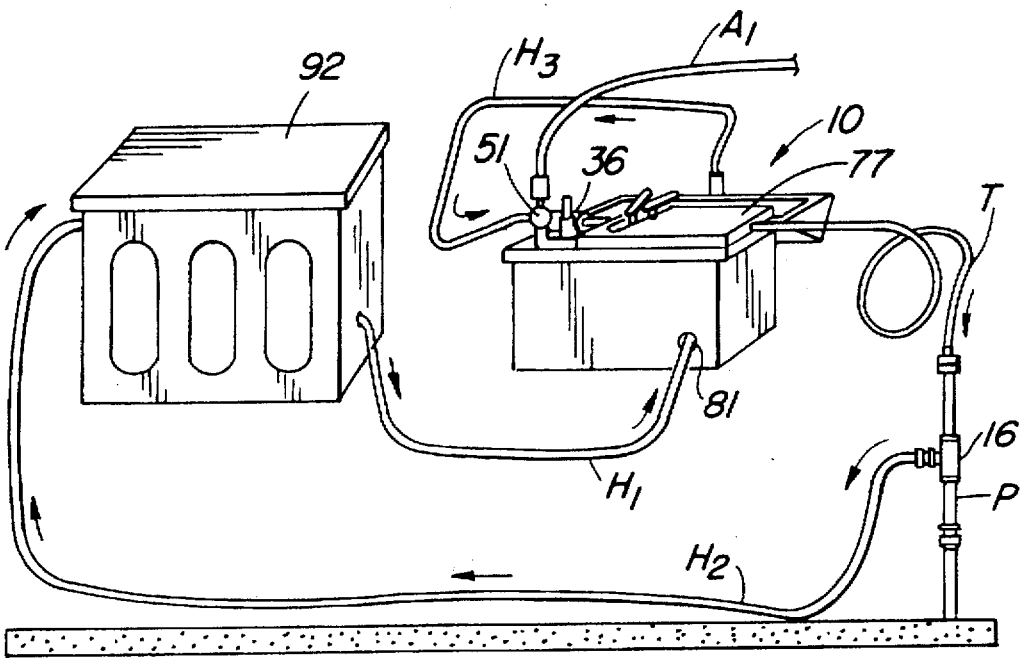
FIG. 4 is view, similar to that of FIG. 1, of the apparatus of the invention being used with a reservoir.

FIG. 3 shows additional, optional, features of the unit 10, which can be used in certain circumstances, for example as shown in FIG. 4.

FIG. 3 shows components contained in the lower portion of container 32, accessible by lifting out the tray 30. These components include a second water conduit, comprising an inlet water pipe 80 having a hose coupling 81 protruding from one side of the container, an outlet water pipe 82 having a hose coupling 83 protruding from the opposite side of the container, and a gear pump 84 connecting these pipes, the pump being mounted on the bottom of the container. A suitable gear pump is Model No. 700721 made by Burke Water Systems Industries 1985 Ltd. of Ville St-Laurent, Quebec, Canada. The gear pump is driven via a flexible coupling 86 and shafts 87 by a compressed air driven rotator in the form of a direct drive air driven drill 88, held by a clip onto a platform 89 mounted on the bottom of the container 32. A suitable drill is a ⅜ inch drill, Model TL1006, sold by Campbell Hausfeld. This drill is supplied with compressed air via a tube 90 which leads out through the side of the container, being provided on the outside with a male quick connecter 91. The parts shown in FIG. 3 normally remain enclosed, the only access required being to the connector 91 and the ends of pipes 80 and 82; the trigger of drill 88 is held closed.

The pump 84 and associated parts may be used either where the water pressure from an available supply such as a hot water tank is insufficient, or where there is no available supply and where hot water has to be brought into the house for the thawing operation. This latter system is illustrated in FIG. 4.

As shown in FIG. 4, the unit 10 is being used in conjunction with a reservoir 92, of about 24 gallon capacity, and which may be, for example, an "Action Packer" (Trademark) made by Rubbermaid Inc. This is brought into the basement, and is then filled with hot or warm water brought in separately in convenient containers. A recirculating system is set up using hose $H_2$ to connect the Tee junction 16 to the reservoir 92, hose $H_1$ to connect the reservoir to the pump inlet pipe 80, and a further short hose $H_3$ to connect the pump outlet pipe 82 to the inlet 36 of the first water conduit. As before, the outlet of this conduit goes to the pipe P via the tube T. Circulation is initiated by opening the valve applying coupling 79' to the connector 91, and applying connector 79" to the connector on top of valve 51, thus providing both the pump 84 and the ratchet tool 50 with compressed air and so providing the tube T with a pulsating supply of pressurized warm water from the reservoir 92. Periodically the valve 70 can be opened, and the coupling 79" can be moved from the valve 51 to the quick connector in elbow 63, to inject compressed air into the pipe.

Figure 5:
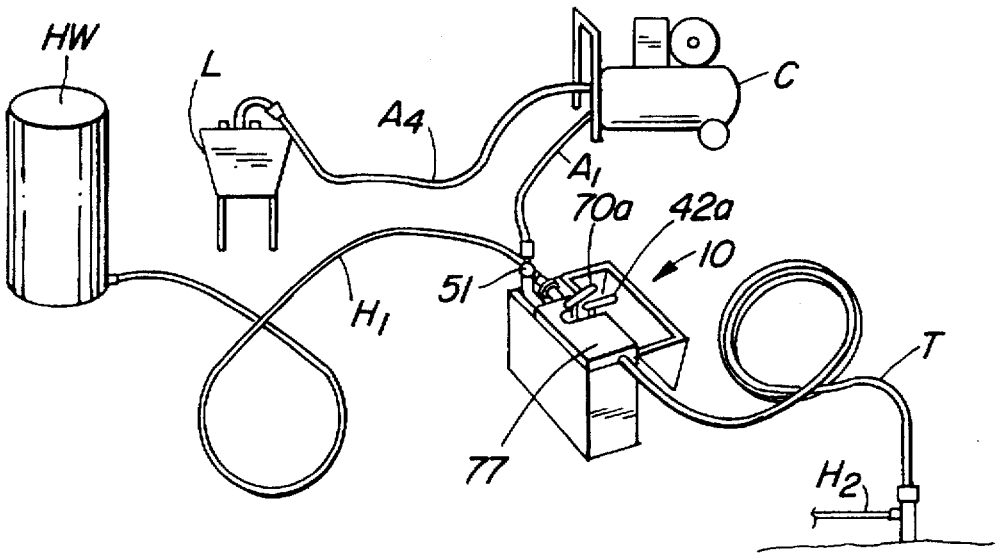
FIG. 5 is a view, again similar to FIG. 1, of a further arrangement in accordance with the invention.

FIG. 5 shows a further option in accordance with the invention. Here, as in FIG. 1, the unit 10 is receiving water from the hot water tank HW of the affected house. However, in order to boost the pressure, an additional air line $A_4$ has been connected between the compressor C and a hose connection on the faucet of the laundry tub L. This increases the pressure throughout the water system of the house, thus increasing the pressure of water delivered to the pipe P by tube T. In case the amount of water in tank HW is not sufficient, it can be recirculated using a reservoir, as in FIG. 4.

The system as described offers the following advantages over other systems presently available, i.e:

a) it is powered entirely by air, thus avoiding the hazards known to exist with the use of electricity, especially in flooded basements where even a minor voltage can be lethal.

b) The use of pulsations speeds the feeding of the thawing tube.

c) Injection of compressed air allows ice and dirt to be blown out of pipes; removal of ice and water speeds the thawing process. Also, the apparatus can be used for cleaning pipes as well as thawing.

d) The apparatus is readily affordable, and is easily maintained and operated.

e) The basic apparatus is a box which can easily be carried in one hand; no cart needs to be carried into a basement.

Tests have shown that the apparatus is also quite fast. In one test, carried out at National Research Council Canada, using hot water at around 43° C. (110° F.) from a faucet, the device thawed 40 ft. of completely frozen ¾ inch copper pipe in about 7 minutes.

I claim:

1. Apparatus for thawing frozen pipes or cleaning pipes, for use with a source of thawing water or cleaning water, a source of compressed air, and a flexible tube suitable for being inserted into the end of a pipe through guide means to feed the water into the pipe while the tube is being advanced into the pipe, comprising:

a) a valved water conduit having an inlet for connection to the source of water and an outlet for connection to said flexible tube;

b) a valve in said water conduit;

c) a compressed air powered drive means connectable to said source of compressed air and arranged to move said valve in such manner as to continually interrupt the flow of water in said conduit and so to produce a pulsating flow of water in said tube for cleaning the pipe or thawing ice in the pipe.

2. Apparatus according to claim 1, wherein the valve has a rotary valve member, and wherein said drive means is effective to rotate said valve member.

3. Apparatus according to claim 2, wherein the drive means incorporates a ratchet drive.

4. Apparatus according to claim 3, wherein said ratchet drive is capable of rotating said valve at a speed of less than 100 r.p.m.

5. Apparatus according to claim 4, wherein the speed of the drive is adjustable.

6. Apparatus according to claim 1, further comprising a pump connected to compressed air powered drive means, said pump having an inlet for connection to said water source, and having an outlet connectable to the inlet of said valved water conduit.

7. Apparatus according to claim 6, wherein said compressed air powered drive means is a compressed air driven drill.

8. Apparatus according to claim 6, wherein said compressed air powered drive means is capable of driving said pump at a speed of between 500 and 1,000 r.p.m.

9. Apparatus according to claim 1, further comprising a compressed air conduit having an inlet for connection to said source of compressed air, an outlet connected to said water conduit, and having a valve which allows compressed air to be injected periodically into the water conduit to clear ice or other matter from the pipe.

10. Apparatus according to claim 1, mounted in a box-like container having a carrying handle and suitable for being carried by one hand.

11. Apparatus according to claim 1, wherein said valved conduit includes a manually operable shut-off valve.

12. Apparatus according to claim 1, including guide means for said flexible tube capable of sliding, sealing engagement with said tube, and having an outlet for connection to a hose for receiving cold return water from the pipe.

13. Apparatus according to claim 1, wherein said source of compressed air includes a compressed air line connectable to a domestic water system which provides said source of water, whereby said domestic system can be pressurized to increase the pressure of water delivered to said valved water conduit.

14. Apparatus for thawing frozen pipes or cleaning pipes, for use with a source of water, a source of compressed air, and a flexible tube suitable for being inserted into the end of a pipe through guide means to feed the water into the pipe while the tube is being advanced into the pipe, comprising:

a) a valved water conduit having an outlet for connection to said flexible tube;

b) a pump having an inlet for connection to said water source, and having an outlet connectable to the inlet of said valved water conduit;

c) a compressed air powered drive means arranged to drive said pump; and d) a compressed air conduit having an inlet for connection to said source of compressed air, having an outlet connected to said valved water conduit, and having a valve which allows compressed air to be injected periodically into the valved water conduit to clear ice or other matter from the pipe.

15. Apparatus according to claim 14, wherein said compressed air powered drive means is a compressed air driven drill.

16. Apparatus according to claim 14, wherein said compressed air powered drive means is capable of driving said pump at a speed of between 500 and 1,000 r.p.m.

17. Apparatus according to claim 14, further comprising a reservoir for receiving water from said pipe, and having a connection to the inlet of said pump.

18. Apparatus for thawing frozen pipes or cleaning pipes, for use with a source of water, a source of compressed air, and a flexible tube suitable for being inserted into the end of a pipe through guide means to feed the water into the pipe while the tube is being advanced into the pipe, comprising:

a) a water conduit having an outlet for connection to said flexible tube;

b) a compressed air driven reciprocating pump having an inlet for connection to said water source, and having an outlet connectable to the inlet of said valved water conduit; said reciprocating pump being such as to produce a pulsating output.

19. Apparatus according to claim 18, further comprising a compressed air conduit having an inlet for connection to said source of compressed air, an outlet connected to said water conduit, and having a valve which allows compressed air to be injected periodically into the water conduit to clear ice or other matter from the pipe.

* * * * *